US005452505A

United States Patent [19]

Gasser

[11] Patent Number: 5,452,505

[45] Date of Patent: Sep. 26, 1995

[54] DEVICE FOR SCREWING-IN AND SETTING SELF-DRILLING BLIND RIVETS

[75] Inventor: Daniel Gasser, Rebstein, Switzerland

[73] Assignees: SFS Rhomberg Gesellschaft M.B.H., Klaus, Austria; SFS Stadler Holding AG., Heerbrugg, Switzerland

[21] Appl. No.: 104,112

[22] PCT Filed: Dec. 10, 1992

[86] PCT No.: PCT/EP92/02861

§ 371 Date: Aug. 11, 1993

§ 102(e) Date: Aug. 11, 1993

[87] PCT Pub. No.: WO93/11890

PCT Pub. Date: Jun. 24, 1993

[30] Foreign Application Priority Data

Dec. 18, 1992 [DE] Germany ..... 41 41 916.2

[51] Int. Cl.[6] ..... B21J 15/34

[52] U.S. Cl. ..... 29/243.526; 29/243.526

[58] Field of Search ..... 29/524.1, 525.2, 29/243.521, 243.526; 72/114, 391.8

[56] References Cited

U.S. PATENT DOCUMENTS

| | | | |
|---|---|---|---|
| 2,384,434 | 9/1945 | Bettington | 218/19 |
| 3,423,986 | 1/1969 | Young | 29/243.526 |
| 3,626,745 | 12/1971 | Richardson | 29/243.626 |
| 5,219,375 | 6/1993 | Kamata et al. | 29/243.526 |

FOREIGN PATENT DOCUMENTS

| | | | |
|---|---|---|---|
| 2253583 | 7/1975 | France . | |
| 4119935 | 12/1992 | Germany | 29/243.526 |
| 4071728 | 3/1992 | Japan | 29/243.526 |
| 1004361 | 9/1965 | United Kingdom . | |

*Primary Examiner*—David Jones
*Attorney, Agent, or Firm*—Helfgott & Karas

[57] ABSTRACT

A device for screwing-in and setting self-drilling blind rivets in a structure, has a clamping unit with two clamping jaws for holding a spindle of a rivet inserted therebetween. The jaws are guided in complementary grooves provided in a retaining unit which is installed in a tubular housing. A cover cap is inserted in the housing for limiting a displacement path of the retaining unit and the clamping jaws in a direction of a central axis of the retaining unit. A shaft to be connected to a driving unit for driving the screwing-in and setting device is inserted in the retaining unit. The shaft acts on a spring-loaded support having radially protruding bolts slidable in longitudinal slits provided in the housing. A displacement path of the retaining unit in the direction towards a free end of the housing is longer than that of the clamping laws.

18 Claims, 2 Drawing Sheets

DEVICE FOR SCREWING-IN AND SETTING SELF-DRILLING BLIND RIVETS

BACKGROUND OF THE INVENTION

The invention pertains to a device for screwing and setting of self-drilling blind rivets, which includes one clamping jaw for holding an installed tensioning spindle in a form-fit or friction-fit manner.

A device of this kind is known, for example, from EP-A 0,213,101. In one retaining unit that has a truncated conical recess on its front end, two clamping jaws are provided diametrically opposite each other. These clamping jaws have on their outer boundary a conical cross-sectional surface so that by means of axial pressing of the clamping jaws into the retaining unit, an inserted tensioning spindle can be grasped and held in place. Since problems of proper rotational catching occur for this type of design since as a consequence of the resulting torque a partial and not necessarily uniform angular displacement of the two clamping jaws can occur. In addition, it is not possible to match the radii of the opening in the retaining unit and the outer region of the clamping jaws at all axial adjusting ranges, so that as a consequence of the impossibility of complete mating, mismatching occurs.

SUMMARY OF THE INVENTION

It is an object of the invention to provide a device of the kind described above in which a precise positional fixing of the clamping jaws takes place and via which an optimum transfer of the necessary torque to the tensioning spindle of the blind rivet to be screwed and set also takes place.

According to this invention, it is proposed that the clamping jaws be of plate-like construction and guided in a retaining unit in an open groove of grooves radial with respect to its middle axis, whereby the base of the groove and the associated boundary surface of one clamping jaw run at the same acute angle to the middle axis of the retaining unit and grow closer together in the direction toward the free end of the retaining unit, and that the latter be held in an axially sliding manner in a housing that can be secured against twisting at least during the setting process.

Due to these features of the invention, the clamping jaws are optimally secured in the direction of rotation, since they are braced on both sides at the guide surfaces, that is, at the lateral bounding surfaces of a radially running groove. This always ensures that the clamping jaws actually act in the direction toward the middle axis of the retaining unit. Thus by an optimum rotational catching of an employed tensioning spindle a blind rivet is secured and no problems of any kind result because of the force absorption in the direction of rotation. The production of clamping jaws is very simple due to the plate-like structure, so that a precision processing is possible by means of punching and milling processes. Thus a much greater selection of materials is possible, so that single sections of the clamping jaws can be prevented from having a brittle material structure, which can occur in particular in manufacturing by means of a pressing step.

When the clamping jaw is not securely pressed down, due to its particular positional lock, proper rotational catching of the tensioning spindle of the blind rivet provided with a force application section is possible, since the jaws cannot move out to the side for any reason. Thus a favorable grasping of the tensioning spindle is possible even for self-drilling blind rivets. In particular when the drill tip is not aligned precisely with the middle axis of the blind rivet and there is the possibility of an irregular motion of the blind rivet during the drilling process, a precisely round hole can still be drilled, and moreover, vibrations will not be transferred to the device itself.

It is particularly favorable that due to the special design and configuration of the clamping jaws, it is now possible that the rotational catching of the blind rivet in the drilling process can occur solely via the tensioning spindle, so that therefore there is no need for an additional application of force to the flange of the rivet casing. Thus it will now be possible to employ rivet casings with painted or otherwise coated surfaces, since again neither during the drilling process nor during the setting process will any engagement with and thus damage to the rivet casing or flange occur.

According to the invention it is also proposed that a displacement limiter be allocated to both the retaining unit and also the clamping jaws in the housing, where the displacement path of the retaining unit is longer in the direction toward the free end of the housing than the displacement path of the clamping jaws in this direction. Thus in a simple manner it has been made possible to release the clamping jaws which have been pressed in the radial direction. Solely by means of an axial motion of the retaining unit, the clamping jaws are loosened so that the section of the tensioning spindle still held in place is released after the setting of the blind rivet.

In this case it is reasonable to provide a cover cap as displacement limiter for the retaining unit at the free end of the housing.

Another favorable measure resides in the fact that the clamping jaws have on their rear end a radially projecting, freely extending tab, and this tab engages with a longitudinal slit in the housing, so that the end of the elongated slit facing the free end of the housing is designed as a displacement limiter for the tab of the clamping jaws. This tab freely extending at the clamping jaws thus form a simple design configuration to bring about the displacement limiting for the clamping jaws. In addition, this tab provides an additional possibility for connecting the retaining unit and the housing together in the direction of rotation. In addition, it is a particular advantage that due to this tab, but also due to the particular mounting of the clamping jaws in the grooves of the retaining unit, a simple replacement of the clamping jaws is now possible. The clamping jaws can be pulled out of the device without dismantling the entire apparatus by grasping the tab. Thus in a simple manner it is possible to remove and reinstall the clamping jaws by means of the longitudinal slit provided in the housing.

According to one embodiment two diametrically opposite grooves are provided in the retaining unit and accordingly also two clamping jaws. Tests have already shown that only two diametrically opposite clamping jaws of the type of the invention are necessary to guarantee proper rotational catching and grasping of the tensioning spindle during the setting process.

Furthermore the limiting surface of the clamping jaws pointing toward the middle axis of the retaining unit runs parallel to this axis. A design of this type is possible in practice only in connection with the mounting of the clamping jaws in radial grooves, since between the base of the groove and the associated boundary surface of the clamping jaws, a steady, uniform contact will occur. This always ensures that an installed tensioning spindle can be securely held along its entire length which is engaged between the clamping jaw.

In order to achieve a form-fit mounting or to increase the friction, in addition to the friction-induced retaining force of the clamping jaws, it is proposed that the limiting surface of the clamping jaws pointing toward the middle axis of the retaining unit have a surface corresponding to the surface configuration of the tensioning spindle to be inserted. In this regard it is advantageous to equip the boundary surface of the clamping jaws pointing toward the middle axis of the retaining unit with transverse ribs, recesses, knobs or a knurled edge.

One preferable embodiment will be obtained when a pin is engaged between the clamping jaws radially directed toward the middle axis of the retaining unit; said pin is aligned on the same axis as the middle axis and is under spring tension. Thus the section of a rivet spindle still remaining in the device after relaxing the tension on the clamping jaws can be ejected in a simple manner.

Even though the retaining unit is already held torsion-locked in the housing by means of the projecting tab of the clamping jaws, it is advantageous when further measures contribute to this effect. Therefore it is provided for the retaining unit to engage with radial projecting bolts into the longitudinal slit of the housing. Thus both an axial displacement between the retaining unit and the housing will be possible, but at the same time, however, there is also a locking in the direction of rotation.

One particular embodiment of this type of the device provides that the projecting bolts pass through longitudinal slits in the housing and along a portion of its length, through a tubular designed retaining unit and proceed from a support unit that can be displaced axially in the middle of the retaining unit. Thus the bolts engage both in the longitudinal slit of the housing and of the retaining unit and lock both these parts in the direction of rotation. Hence, the possibility thus arises of obtaining additional function from the support unit of the bolts.

In particular, it is advantageous when the support unit is under spring tension in the direction of the clamping jaws and is braced in the region of the clamping jaws extending in an axial direction to the grooves. Thus the clamping jaws can be of a simple spring-loaded design always under load in the direction of tension, so that this spring effect will by no means be a hindrance to the insertion of the tensioning spindle into the device. Due to this action it is assured that the clamping jaws are always held in their appropriate position in the retaining unit and thus in a lossproof manner. To replace the clamping jaws it is necessary merely to lift up this support unit by grasping the radial projecting bolt against the force of the spring so that the clamping jaws will be exposed. The clamping jaws can then be grasped by their projecting tab and pulled out.

But the support unit can also take on additional functions, specifically when the spring-loaded pin is guided in the support element and is separately under spring tension. Thus it is possible in a simple design to hold the pin engaged between the clamping jaws and bring about the ejection of the separated tensioning spindle in a proper manner and to have a spring-loaded design.

The entire design of the device is quite simple and can also be coupled to a drive unit in a simple manner. Therefore it is advantageous to employ a shaft that can be connected to a drive unit or a tensioning device; said shaft is employed at the end of the retaining unit turned away from the free end.

In the simplest design of the device it is provided that the grooves open toward the middle axis of the retaining unit lead to a middle, equi-axis hole. But with this type of design, two work steps will be required, i.e., the production of the drilled hole and of the grooves in a milling process.

Specifically, due to the particular design of the clamping jaws and the grooves provided to guide them, it has become possible to produce the mounts for the employed clamping jaws in one work step. To do this, it is proposed that two grooves located opposite each other in a plane pass directly into each other in the retaining unit and thus form a single, wedge-shaped recess located symmetrical to the middle axis of the retaining unit. A groove of this kind can be produced in a simple manner by using a milling tool, and this also ensures that the tensioning spindle cannot engage with the side next to the mutually facing boundary surfaces of the clamping jaws. Thus the tensioning spindle will always be employed between the mutually facing boundary surfaces of the clamping jaws that pass over the entire width of the groove.

To improve the displacement potential of the clamping jaws in the grooves and for a more precise control of them in the grooves, it is proposed that the base of the groove and the associated limiting surface of the clamping jaw are formed with an arched cross section. A design of this kind is only possible for the formation of grooves since the arched shape or the radius of the boundary surface is equal respectively over the entire length of the base of the groove or over the entire length of the associated boundary surface of the clamping jaw.

In order to allow an even easier and simpler replacement of the clamping jaws, it is proposed that longitudinal slits be located separately and at an angular offset to each other on the housing and provided to engage the tab of the clamping jaws and for the projecting bolt of the retaining unit or of the support unit. Therefore, the bolts, for example, can be pulled back against the force of the spring so that the clamping jaws can be grasped, e.g., in the slits resting at a 90° offset to it and then pulled out or reinserted.

Since the tensioning spindle need not necessarily be securely clamped between the clamping jaws for a proper rotational catching during the drilling process, so that of course an optimum and vibration-free drilling process will result, it is advantageous if the employed rivet is held in a lossproof manner in the device. To do this it is proposed that the cover cap provided on the free end of the housing have an inner width for insertion of a tensioning spindle, where radial, spring-loaded retaining features are provided in the region of the inner width. Due to this supplemental measure it will be assured that a blind rivet installed in the device will be held in a lossproof manner in the device until the drilling process or until the setting process.

Additional properties and special advantages of the invention will be explained in greater detail based on the figures and the following description.

DETAILED DESCRIPTION OF THE PREFERRED EMBODIMENTS

Figure 1:
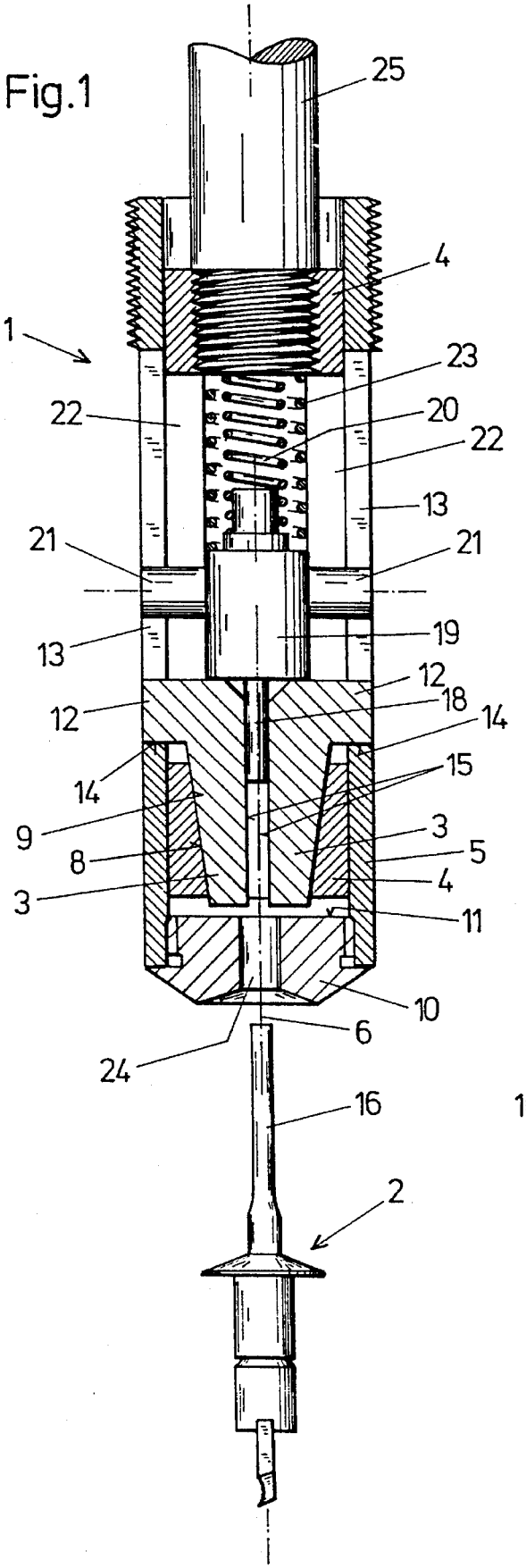
FIG. 1 is a longitudinal cross section of the device of the invention, with a blind rivet located in the position of insertion position.
Figure 4:
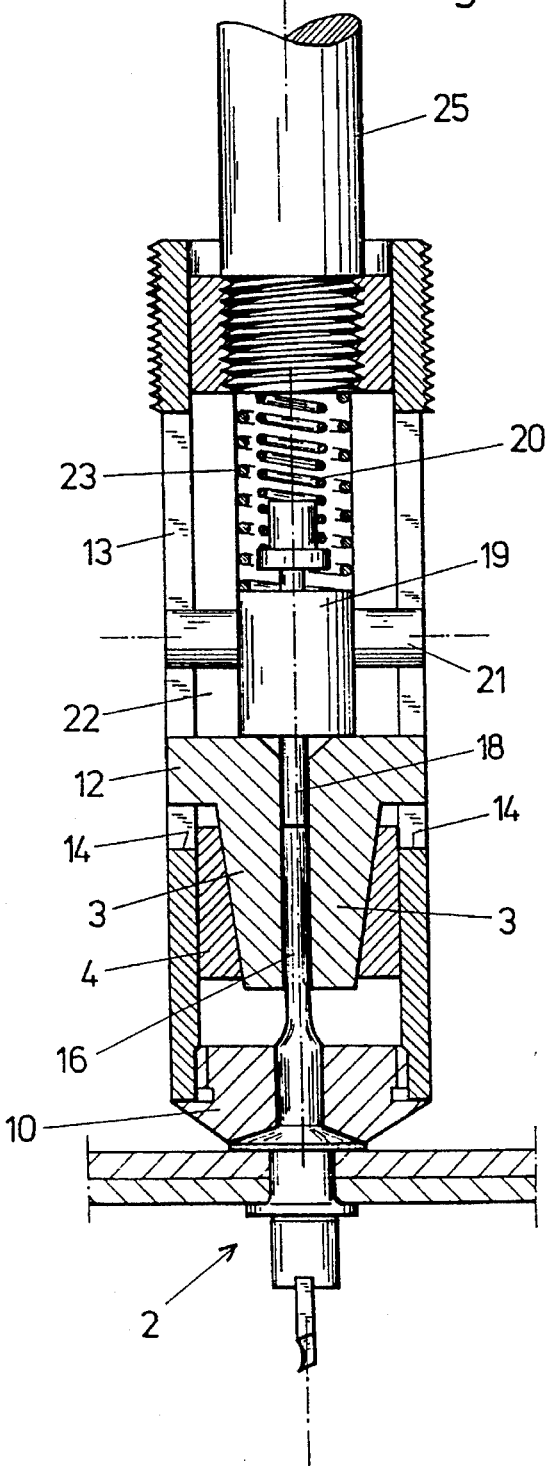
FIG. 4 is a longitudinal cross section through the device in a position after completion of the setting process of the blind rivet.

The device 1 for screwing and setting of self-drilling blind rivet 2 consists essentially of clamping jaws 3, a retaining unit 4 and a housing 5. The clamping jaws 3 are of plate-like design and are guided in the retaining unit 4 in open grooves 7 radial with respect to its middle axis 6. The base 8 of the groove and the associated boundary surface 9 of one clamping jaw 3 run at the same acute angle to the middle axis 6 and are tapered toward the free end of the clamping jaw.

In the housing 5, a displacement limiter is provided both for the retaining unit 4 and also for the clamping jaws 3, where the displacement path of the retaining unit 4 is longer in the direction toward the free end of the housing 5 than the displacement path of the clamping jaws 3 in this direction. A sealing cap 10 is provided as a displacement limiter for the retaining unit 4 at the free end of the housing 5. The inner surface 11 of this sealing cap 10 forms a stop as displacement limiter for the retaining unit 4 in the direction of the free end of the housing 5.

The clamping jaws 3 have on their rear end a radially outward, freely projecting tab 12 that engages in a longitudinal slit 13 in the housing 5. The end 14 of this longitudinal slit 13 facing the free end of the housing 5 is designed as a displacement limiter for the tab 12 of the clamping jaws 3. Therefore, if the tab 12 of the clamping jaws 3 comes to rest at the end 14 of the longitudinal slit 13, then the retaining unit 4 can still be moved in the direction toward the sealing cap 10, without the clamping jaws 3 being able to follow. Thus in a simple manner it will be possible to loosen the clamping jaws 3 when they are in a clamped setting.

The illustrated embodiment provides for two diametrically opposing grooves 7 in the retaining unit 4 and accordingly two clamping jaws 3. Within the framework of the invention, it is also possible to provide only one clamping jaw 3 so that it will then find an opposing, fixed contact surface in the retaining unit 4. But it would also be possible to employ more than two clamping jaws 3 and corresponding grooves, that is, for example three or more clamping jaws 3 and grooves 7.

The boundary surfaces 15 of the clamping jaws 3 pointing to the middle axis 6 of the retaining unit 4 run parallel to the middle axis 6 and thus also parallel to each other. Thus it is possible to clamp the entire length of the tensioning spindle with constant force. But the boundary surfaces 15 can also have a surface corresponding to the surface configuration of the employed tensioning spindle 16 in order to improve still more the retaining effect during the tightening process. In this case it would be possible to provide these boundary surfaces 15 with transverse ribs, recesses, knobs or a knurled edge.

Figure 3:
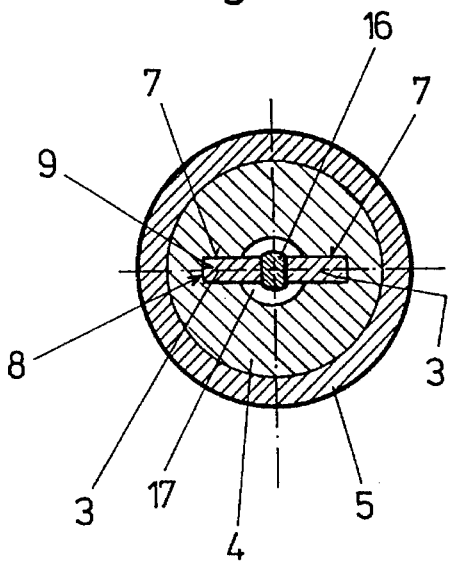
FIG. 3 is a cross section along line III—III in FIG. 2.

As indicated in FIG. 3, the grooves 7 that are open toward the middle axis of the retaining unit 4 open into a central, equi-axial [sic; possibly, colinear] hole 17. But it would also be possible that the two grooves 7 located opposite each other in a plane pass directly into each other in the retaining unit 4 and thus form a single, wedge-shaped recess located symmetrically to the middle axis of the retaining unit 4. Between the facing boundary surfaces 15 of the clamping jaws 3 there remains only one corresponding opening into which the tensioning spindle 16 of the employed blind rivet 2 can be inserted. Thus, a secure mounting of the tensioning spindle is assured since it cannot escape out to the side next to the clamping jaws 3.

One preferable embodiment is also manifested in the fact that the base 8 of the groove and the allocated limiting surface 9 of the clamping jaw 3 are formed with an arched cross section. The configuration is easily implemented when using a milling cutter for the production of the grooves 7, where this design ensures excellent control without tilting and without stress concentration for clamping jaws 3.

Figure 2:
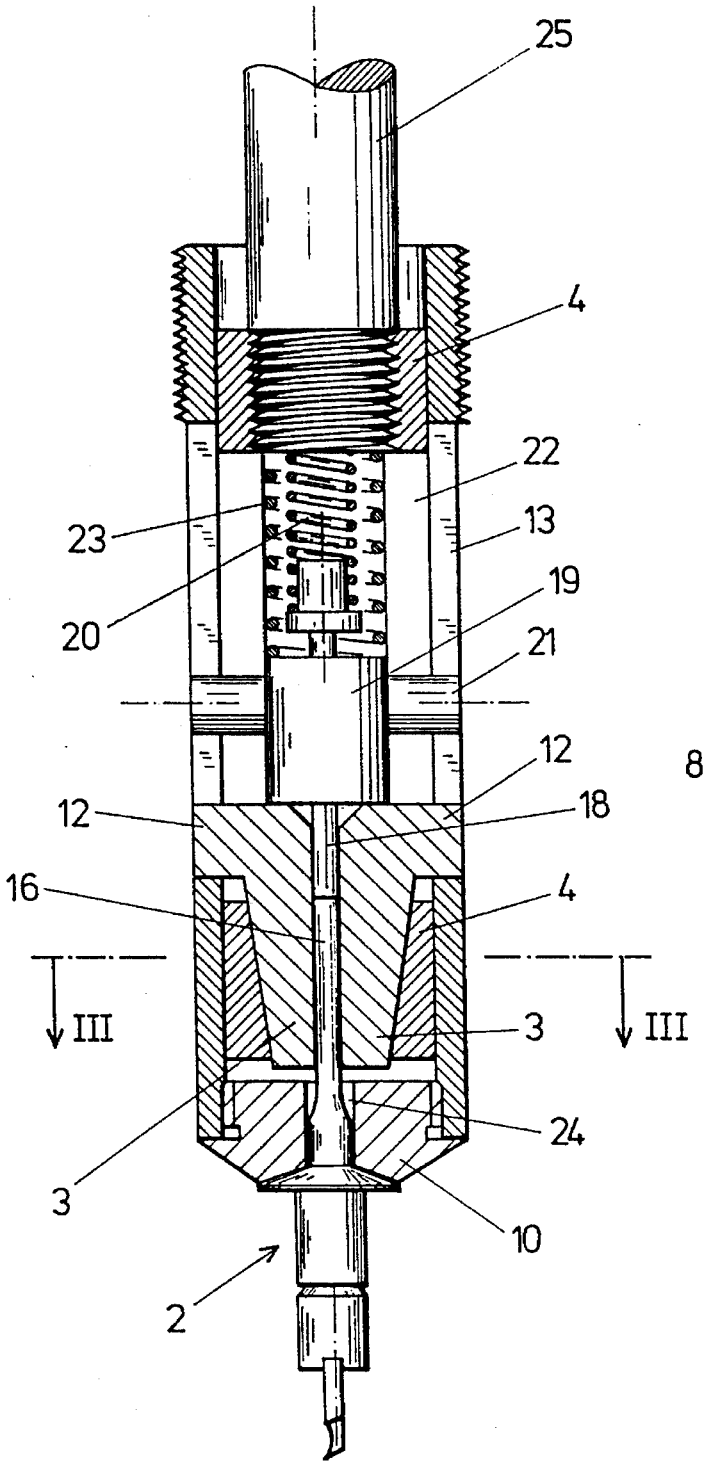
FIG. 2 shows the same longitudinal cross section through the device, where the blind rivet is inserted in the device.

A pin 18, sliding under spring tension and aligned on the same axis as the middle axis 6, engages between the clamping jaws 3 directed between the retaining unit 4 radial with respect to the middle axis 6. This pin 18 is maintained in sliding fashion in a support element 19 and is pressed by a spring 20 into its working position. When the tensioning spindle 16 is used and after the setting process, the pin 18 will cause an ejection of the snapped off tensioning spindle 16 from the device. When pressing in the tensioning spindle 16, the pin 18 will be pressed farther into the device against the force of spring 20 (see FIG. 2), so that after loosening the clamping jaws 3 and thus after release of the tensioning spindle 16, said spindle will be ejected by the spring-loaded recoiling pin 18.

The retaining unit 4 is held torsion-locked in housing 5. For this purpose, bolts 21 are provided that engage in the longitudinal slit 13 at the housing 5. The projecting bolts 21 pass through both the longitudinal slit 13 in the housing 5, and also the longitudinal slit 22 in the retaining unit 4 designed in tubular fashion across a portion of its length. The bolts 21 emanate from a support 19 displaced axially in the retaining unit 4. This support unit 19 is loaded by a spring 23 so that the support unit 19 will be braced against the region of the clamping jaws 3 protruding in an axial direction over the grooves 7. Thus the support unit 19 will cause the clamping jaws 3 always to be in their proper working position and held in a lossproof manner in the device.

If the clamping jaws are to be replaced, then the support unit 19 can be pulled toward the rear end of the device 1 simply by grasping the bolt 21, whereupon the clamping jaws 3 can then be grasped by the tab 12 and pulled out through the longitudinal slit 13. The installation of new clamping jaws is also possible in the same simple manner.

In this regard it is expedient to ensure simple handling by providing separate and angular offset longitudinal slits 13 on the housing 5 for access to the tab 12 of the clamping jaws 3 and for the projecting bolts 21 of the support unit 19. The support unit 19 can then be lifted in a simple manner, whereby the clamping jaws 3 will be grasped at a 90° offset to the corresponding longitudinal slits and then removed or installed through this.

The sealing cap 10 provided on the free end of the housing 5 has an inner width 24 for insertion of a tensioning spindle 16 of a blind rivet. In order to hold the blind rivet in the installed position in lossproof fashion, even when the clamping jaws 3 are not yet applied in a force- or friction-fit manner, it is useful to provide a radial, spring-loaded retaining feature in the region of the inner width 24 of the sealing cap 10. These retaining features can be designed in various ways, e.g., by spring-loaded pins or spring parts or spring-loaded balls etc., installed in drilled holes opening radially to the inner width 24.

In order to connect the device according to this invention with a drive unit or a tensioning device, a shaft 25 is provided on the free end of the retaining unit 4. This shaft 25 and the housing 5 can be coupled to a corresponding drive unit that will cause rotation when drilling the hole and tensioning when setting the rivet. The device according to this invention is thus a type of supply unit for a riveting device so that by means of this supply unit a set rivet spindle of a blind rivet can be held in the proper position in an orderly manner during the drilling process and also during the setting process.

I claim:

1. A device for screwing-in and setting self-drilling blind rivets in a structure, the device comprising clamping jaws for holding a tensioning spindle of a rivet inserted therein so that said spindle is fit in said jaws, said jaws being of a plate-shaped configuration; a retaining unit having a central axis and open grooves which open towards said central axis, said jaws being guided in said grooves of said retaining unit, each groove having a groove base and each jaw having a complementary boundary surface, each groove base and the boundary surface complementary thereto running at an equal acute angle to said central axis and tapering towards a free end of said retaining unit; a housing surrounding said retaining unit which is positioned therein slidably in a direction of said central axis; driving means coupled to said retaining unit for displacing said retaining unit and said clamping jaws; means to secure said housing against twisting at least during a setting process; and a first displacement limiter held in said housing for limiting a displacement of said retaining unit and said jaws, wherein a displacement path of said retaining unit in a direction toward a free end of said housing is longer than that of said clamping jaws, said jaws each having, at a rear end thereof opposite to said free end of said housing, a radially outwardly protruding tab, said housing having longitudinal slits each engaging a respective protruding tab, each slit having an end face formed as a second displacement limiter for the respective tab of each clamping jaw.

2. The device according to claim 1, wherein the first displacement limiter is a cover cap provided for the retaining unit at the free end of the housing.

3. The device according to claim 2, wherein said cover cap provided on the free end of the housing has an inner hole for insertion thereinto of said tensioning spindle of a rivet being set and wherein radial, spring-loaded retaining properties are provided in said cap in a region of the inner hole thereof.

4. The device according to claim 1, wherein two diametrically opposing grooves are provided in the retaining unit and accordingly two clamping jaws are guided in said grooves of said retaining unit.

5. The device according to claim 1, wherein each law has a limiting surface facing to the central axis of the retaining unit and running parallel to said axis.

6. The device according to claim 5, wherein said limiting surface has a surface configuration corresponding to a surface configuration of the tensioning spindle of a rivet to be inserted into said jaws.

7. The device according to claim 6, wherein said limiting surface has elements thereon selected from the group consisting of transverse ribs, recesses, knobs and a knurled edge.

8. The device according to claim 1, and further comprising a spring-loaded movable pin which is colinear with the central axis of the retaining unit and which is engaged between the clamping jaws which are radially positioned with respect to said central axis of the retaining unit.

9. The device according to claim 1, wherein the retaining unit is held torsion-locked in said housing.

10. The device according to claim 9, and further comprising bolts each radially projecting into and being engaged in a respective one of said longitudinal slits of the housing.

11. The device according to claim 10, wherein said retaining unit is tubular at least at a portion of length thereof; and further comprising a support unit displaced along said axis in said retaining unit by said driving means, said retaining unit having longitudinal slits, and wherein said radially projecting bolts protrude from said support unit and pass through said longitudinal slits of each of said retaining unit and of said housing.

12. The device according to claim 11, and further comprising a spring acting on the support unit which is under spring tension in a direction towards the clamping jaws and is braced in a region of the clamping jaws guided in said grooves.

13. The device according to claim 11, and further comprising a spring-loaded pin guided in the support unit and is separately therefrom under spring tension.

14. The device according to claim 11, wherein said longitudinal slits in said housing are separated from each other and are angularly offset from each other and are formed each to engage the protruding tab of the respective clamping jaw and to engage a respective radially projecting bolt.

15. The device according to claim 1, wherein said driving means includes a shaft which can be connected to a drive unit or a tensioning device, said shaft being provided at an end of the retaining unit opposite to said free end thereof.

16. The device according to claim 1, wherein said retaining unit has a central equi-axial hole and said grooves which open toward the central axis of the retaining unit open into said central equi-axial hole.

17. The device according to claim 1, wherein two grooves are provided, located opposite each other to extend directly into each other in the retaining unit and thus form a single, wedge-shaped recess located symmetrically to the central axis of the retaining unit.

18. The device according to claim 1, wherein said groove base and the complementary boundary surface of the respective clamping jaw are formed with an arched cross section.

* * * * *